United States Patent [19]

Miyamoto et al.

[11] 4,366,464

[45] Dec. 28, 1982

[54] IGNITION CABLES

[75] Inventors: Yoshimi Miyamoto, Aichi; Keiichi Kojima; Yasuo Toriumi, both of Osaka, all of Japan

[73] Assignees: Sumitomo Electric Industries, Osaka; Nippondenso Co., Ltd., Aichi, both of Japan

[21] Appl. No.: 230,929

[22] Filed: Feb. 2, 1981

[30] Foreign Application Priority Data

Jan. 31, 1980 [JP] Japan ..... 55-11443[U]

[51] Int. Cl.[3] ..... H01C 3/06

[52] U.S. Cl. ..... 338/214; 338/66

[58] Field of Search ..... 338/66, 214; 174/120 SC, 113 R, 102 SC, 105 SC, 106 SC, 104; 252/510, 511; 156/50, 51, 52; 427/118; 428/373, 36

[56] References Cited

U.S. PATENT DOCUMENTS

| | | | |
|---|---|---|---|
| 3,725,230 | 3/1971 | Bahder et al. | 174/120 SC X |
| 3,876,462 | 4/1975 | Carini et al. | 174/120 SC X |
| 3,878,319 | 4/1975 | Wahl | 174/120 SC X |

*Primary Examiner*—C. L. Albritton

*Attorney, Agent, or Firm*—Sughrue, Mion, Zinn, Macpeak & Seas

[57] ABSTRACT

A high voltage ignition cable is described comprising a resistive-conductor core, an insulator layer provided thereon, and a jacket, wherein said insulator layer comprises a cross-linked product of a polymer composition consisting of crystalline polyethylene and a non-crystalline olefin polymer.

7 Claims, 3 Drawing Figures

IGNITION CABLES

BACKGROUND OF THE INVENTION

This invention relates to improvements in a high voltage ignition cable (hereinafter referred to as an "ignition cable") which is used to suppress radio interference generated by electrical ignition in an internal combustion engine, e.g., in a car, etc.

When conductive substances such as salts (e.g., for the prevention of freezing of roads in a cold district), sludge, etc., attach onto the external surface of a jacket of the ignition cable and the impedance thereof relative to the ground potential is lowered, the charging current flows out thereto according to the electrostatic capacity between a resistive-conductor core (hereinafter referred to as a "core", for simplicity) and the external surface of the jacket.

Therefore, as the electrostatic capacity increases, a reduction in the ignition voltage increases, resulting in poor ignition. In order to eliminate such poor ignition, it is necessary to use an ignition cable having as low an electrostatic capacity as 80 pF/m or less.

One way of lowering the electrostatic capacity is to increase the outer diameter of the ignition cable. However, increasing the outer diameter is not desirable, since the outer diameter of the ignition cable is usually about 7 or 8 mm, in that the ignition cable obtained can not be exhanged with conventional ones, and requires additional space.

In order to lower the electrostatic capacity while holding the outer diameter at a constant level, it is necessary to reduce the outer diameter of the core, and in order to lower the electrostatic capacity to the above-described level of 80 pF/m or less, it is necessary to reduce the outer diameter of the core to 1.2 mm or less.

By merely reducing the outer diameter of the core, however, the core will be cut off during the course of extrusion or vulcanization of the insulator, jacket, or the like, and thus it is not possible to produce, on a commercial scale, ignition cables which are sufficiently stabilized in high voltage withstanding ability, as in the case where glass fiber bundles are used as a tension member. The use of aromatic polyamide fiber bundles instead of the glass fiber bundle avoids the above-described defects but does not give a sufficient high voltage withstanding ability as described hereinafter. Furthermore, stabilized ability of the high voltage withstanding and problems such as difficulty in working of termination of the cable, etc., arise.

SUMMARY OF THE INVENTION

An object of this invention is to provide an ignition cable which has a sufficiently low electrostatic capacity and an excellent high voltage withstanding ability.

Another object of this invention is to provide an ignition cable having an excellent high voltage withstanding ability, which is prepared based upon the finding that when an insulator layer is prepared using a cross-linked product of the polymer composition consisting of polyethylene and a non-crystalline olefin polymer, in place of a cross-linked polyethylene, the insulator layer obtained is improved in its high voltage withstanding ability and has flexibility like rubber-based materials.

A further object of this invention is to eliminate various problems resulting from a reduction in the outer diameter of a core, by using an aromatic polyamide fiber bundle as a tension member constituting the core, and to provide an ignition cable having a sufficiently electrostatic capacity.

Still another object of this invention is to provide an ignition cable which is easy in performing termination and has an excellent high voltage withstanding ability, by bringing a core into sufficiently close contact with an insulator layer in order to obtain a stabilized high voltage withstanding ability and by employing a core of a multi-layer construction, i.e., a core comprising a tension member, an inner semiconductive layer, a conductive stripping layer, and an outer semiconductive layer which comes into close contact with an insulative material. Use of the core of such a multi-layer construction permits to overcome the poor high voltage withstanding ability resulting from micropores formed in uneven surface of a core and in the interface of the core and an insulator layer, and to sufficiently exhibit the excellent high voltage withstanding ability of the insulator layer itself, which is prepared by coating a composition of polyethylene and a non-crystalline olefin polymer and cross-linking the resulting coated layer.

The gist of this invention resides in high voltage ignition cable having a low electrostatic capacity, which comprises a resistive-conductor core, an insulator layer and a jacket wherein the insulator layer comprises a cross-linked product of a composition consisting of polyethylene and a non-crystalline olefin polymer.

In this invention, it is preferred that the resistive-conductor core is prepared by using an aromatic polyamide fiber bundle as a tension member and by coating thereon a semiconductor paint and drying so that the outer diameter be 1.2 mm or less.

More preferably, the resistive-conductor core comprises a tension member, an inner semiconductive layer, an outer semiconductive layer, and a stripping layer interposed between the inner and outer semiconductive layers.

More preferred embodiments of this invention will become apparent from the examples as described hereinafter in detail.

DETAILED DESCRIPTION OF THE INVENTION

In order to suppress radio interference generated by ignition system, a core of an ignition cable is required to have a resistance of about 16 KΩ/m. In general, therefore, a core having a diameter of about 1.8 mm which is prepared by impregnating a glass fiber bundle with a carbon paint has been used.

When the diameter of the core prepared using the glass fiber bundle is reduced to lower the electrostatic capacity of the ignition cable, the core may be cut in the course of extrusion or vulcanization of the insulator layer, jacket, or the like. This makes the commercial production of such an ignition cable difficult.

Figure 1:
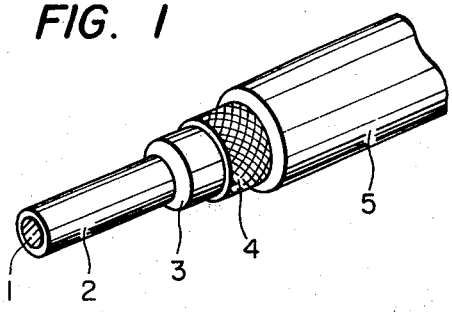
FIG. 1 is a perspective view of an ignition cable having a low electrostatic capacity.

The above defect encountered in the use of the glass fiber bundle can be overcome by using an aromatic polyamide fiber bundle of high strength as a tension member of the core. For example, as illustrated in FIG. 1, by impregnating a 1,500 denier aromatic polyamide fiber bundle 1 with a carbon paint (i.e., a mixture of carbon black and a fluid binder which are dispersed in a solvent) 2 to provide a core having an outer diameter of from 0.9 mm to 1.2 mm, and providing on the thus-obtained core an insulator layer 3 comprising a cross-linked product of a composition consisting of polyethylene and a non-crystalline olefin polymer, a glass braid 4, and an ethylene-propylene rubber (EP rubber) or silicone rubber jacket 5, in that sequence, an ignition cable having a low electrostatic capacity of about 80 pF/m can be obtained. In order to obtain as low an electrostatic capacity as 80 pF/m or less, it is necessary to reduce the outer diameter of the core to 1.2 mm.

It has been found, however, that the thus-obtained ignition cable of a low electrostatic capacity suffers from the disadvantage that its high voltage withstanding ability is unstable, and it is insufficiently durable for long and repeated use. That is, if an ignition coil voltage withstanding test in which 30 KV of peak voltage was repeatedly aplied to using an ignition coil, such an ignition cable is poor in high voltage withstanding ability.

As a result of extensive investigation to improve the poor high voltage withstanding ability, it has been found that a cross-linked product of a polymer blend comprising polyethylene and a non-crystalline olefin polymer, e.g., EP rubber and an ethylene-α-olefin copolymer, in place of the cross-linked polyethylene, significantly increases the high voltage withstanding ability and provides good results in the ignition coil withstand voltage test.

The phenomenon that blending of crystalline polyethylene and a non-crystalline olefin polymer increases the high voltage withstanding ability is very unexpected.

As will be described hereinafter, a comparison of the cross-linked product of polymer blend comprising crystalline polyethylene and a non-crystalline olefin polymer with the cross-linked product of polyethylene alone in sheet form testing appears to indicate that the latter cross-linked product of polyethylene alone is higher in high voltage withstanding ability than the former cross-linked product of the polymer blend.

Irrespective of this fact, however, when the polymer blend of the polyethylene and non-crystalline olefin polymer is used in the insulator layer of the ignition cable, unexpectedly, the high voltage withstanding ability is increased and the cable obtained passes the ignition coil voltage withstanding test.

Based on this finding, this invention has been made.

Non-crystalline olefin polymers which can be used in this invention include an ethylene-propylene copolymer (including an ethylene-propylene-diene terpolymer (EPDM) and an ethylene-α-olefin copolymer (e.g., a 4-methylpentane-1-ethylene copolymer).

As a result of extensive studies on the poor high voltage withstanding ability of the ignition cable, it has been found that irregularities in the surface of the core and a vacant space or void beween the core and the insulator are responsible therefor. Therefore, if the above causes are removed, the excellent high voltage withstanding ability of the insulator layer comprising the above polymer blend will be more efficiently exhibited and an ignition cable having a more stabilized high voltage withstanding ability will be obtained.

The first cause, i.e., the irregular surface of the core, can be removed by extruded layer on the core with, for example, a semiconductive rubber or plastics, or coating with a paint having a high viscosity.

In order to eliminate the second cause, i.e., the vacant space or void between the core and the insulator layer, it is necessary to bring the core into sufficiently close contact with an insulative material to be coated on the outer surface of the core. However, with an ignition cable in which the core and the insulative material are brought into close contact with each other, if the insulator layer is peeled off in working of termination, the semiconductive layer of the core will be also peeled off, resulting in poor conduction with the terminal.

In order to eliminate the irregularity in the surface of the core and the vacant space or void between the core and the insulative material, which are responsible for the poor high voltage withstanding ability, and at the same time, to make the working of termination easy, it is preferred tht the core is comprising a tension member, an inner semiconductive layer, an outer semiconductive layer and a stripping layer interposed between the inner and outer semiconductive layers, in that sequence.

In ignition cables having a core of the above-described construction, the high voltage withstanding ability which is increased by employing the insulator layer comprising the polymer blend of the polyethylene and non-crystalline olefin polymer can be stabilized for a much longer period of time since the outer semiconductive layer and the insulator layer are in close contact with each other. Furthermore, although the outer semiconductive layer is peeled off together with the insulator layer from the stripping layer in the working of termination, the inner semiconductive layer still remains and, therefore, the remaining portion of the core still has sufficient conductivity, keeping good contact with terminals.

Hereinafter this invention will be explained in detail with reference to the accompanying drawings.

FIG. 1 is a perspective view of an ignition cable having a low electrostatic capacity, and generally represents both the example and comparative example described hereinafter. In FIG. 1, numeral 1 indicates a tension member consisting of an aromatic polyamide fiber bundle, numeral 2 indicates a semiconductive paint layer, numeral 3 indicates an insulator layer, numeral 4 indicates a reinforcing layer, e.g., a braiding layer, and numeral 5 indicates a jacket.

Table 1 shows the dimension of each element constituting a low electrostatic capacity ignition cable according to an example of this invention and a comparative example. On a 1,500 denier aromatic polyamide fiber there was repeatedly coated (usually 4 to 10 times) a semiconductive paint as a resistive-conductor, said semiconductive paint being prepared by mixing a conductive substance, such as carbon black, graphite, silver, or copper powder, with rubber, plastic or the like, such that the outer diameter was from 0.9 to 1.2 mm.

Next, in order to obtain the low electrostatic capacity, a low dielectric constant material, such as polyethylene, an ethylene-propylene copolymer (including an ethylene-propylene-diene terpolymer (EPDM), an ethylene-α-olefin copolymer, or blend polymers thereof, were extruded as an insulator, cross-linked by the steam vulcanization method, and finished to from a 4.6 to 4.8 mm diameter.

Next, a glass fiber braid was provided thereon as a reinforcing layer, and EP rubber or silicone rubber was extruded on the glass fiber braid. The outer diameter, was finished to 7.0 mm. The formulation of the insulator used herein is described in Table 2.

The test results of the electrostatic capacity and the ignition coil voltage withstanding ability are shown in Table 3. Although Sample No. G of the comparative example, which is insulated by the cross-linked polyethylene, was nearly the same as those of the example of this invention with respect to the low electrostatic capacity, it broke down in a markedly short period of time in the ignition coil voltage withstanding test as compared with the other samples, according to this invention.

The electrostatic capacity was measured according to JIS C-3004, the "Rubber Insulated Cable Testing Method", particularly, the sample was immersed in water, grounded, and the electrostatic capacity between the conductor and water was measured by the AC bridge method at a frequency of 1,000 Hz and expressed as a value per meter of the length.

Figure 2:
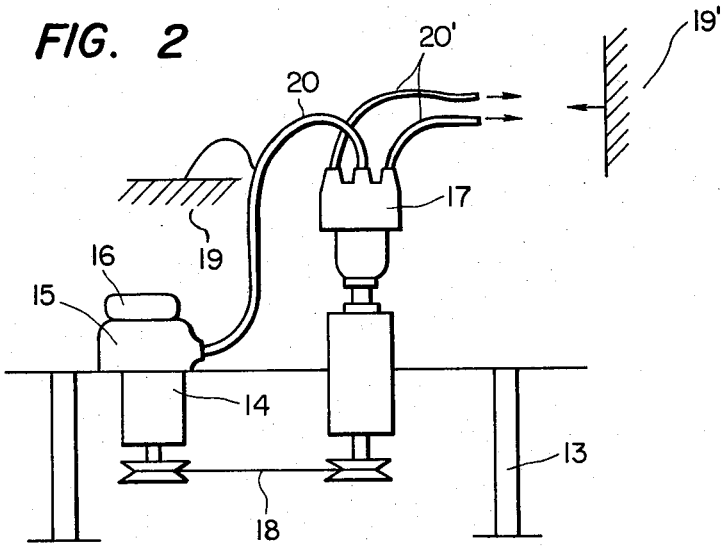
FIG. 2 is a diagrammatic representation of an apparatus for use in an ignition coil voltage withstanding test.

FIG. 2 is a diagrammatic representation of an apparatus used in the ignition coil voltage withstanding test, in which numeral 13 indicates a frame, numeral 14 a motor, numeral 15 a coil, numeral 16 an ignitor, numeral 17 a distributor (rotated at 1,000 rpm), numeral 18 a driving belt, numeral 19 and 19' the ground, and numeral 20 and 20' ignition cables. The surface of the ignition cable is coated with a silver paint on the surface thereof and grounded, and 30 KV applied voltage on the core is discharged in a needle gap provided between the conductor of the cable 20' and the ground 19'.

The ignition cable according to the invention having low electrostatic capacity is excellent in preventing problems caused by salts in a cold district, etc.

TABLE 1

| Low Electrostatic Capacity Ignition Cables | Design I | | Design II | |
|---|---|---|---|---|
| | Thickness (mm) | Outer Diameter (mm) | Thickness (mm) | Outer Diameter (mm) |
| Core | | | | |
| Aromatic Polyamide Fiber Bundle (1,500 denier) | | 0.5 | | 0.5 |
| Semiconductive Paint | 0.20 | 0.9 | 0.35 | 1.2 |
| Insulator | | | | |
| Polyolefin Resin | 1.85 | 4.6 | 1.80 | 4.8 |
| Reinforcing Braid | | | | |
| Glass Yarn | 0.10 | 4.8 | 0.10 | 5.0 |
| Jacket | | | | |
| Olefin Resin | 1.1 | 7.0 | 1.00 | 7.0 |

TABLE 2

| | Formulation of Insulator | | | | |
|---|---|---|---|---|---|
| | Crystalline Polyethylene | EP | Toughmer* A | Cross-Linking Agent | Anti-Aging Agent |
| Example | | | | | |
| A | 80 | 20 | — | slight | slight |
| B | 60 | 40 | — | " | " |
| C | 50 | 50 | — | " | " |
| D | 80 | — | 20 | " | " |
| E | 60 | — | 40 | " | " |
| F | 50 | — | 50 | " | " |
| Comparative Example | | | | | |

TABLE 2-continued

| | Formulation of Insulator | | | | |
|---|---|---|---|---|---|
| | Crystalline Polyethylene | EP | Toughmer* A | Cross-Linking Agent | Anti-Aging Agent |
| G | 100 | — | — | " | " |

Note:
*Toughmer: Ethylene-α-olefin copolymer produced by Mitsui Petrochemical Co., Ltd.

TABLE 3

| Characteristics of Low Electrostatic Capacity Ignition Cables | Electrostatic Capacity** (pF/m) | Voltage Withstanding Test of Ignition Coil | |
|---|---|---|---|
| Example A | | | |
| Design I | 76 | 2000 H | 5 pieces OK |
| Design II | 80 | 2000 H | 5 pieces OK |
| Sample B | | | |
| Design I | 75 | 2000 H | 5 pieces OK |
| Sample C | | | |
| Design I | 76 | 2000 H | 5 pieces OK |
| Design II | 79 | 2000 H | 5 pieces OK |
| Sample D | | | |
| Design I | 75 | 2000 H | 5 pieces OK |
| Design II | 79 | 2000 H | 5 pieces OK |
| Sample E | | | |
| Design I | 74 | 2000 H | 5 pieces OK |
| Sample F | | | |
| Design I | 75 | 2000 H | 5 pieces OK |
| Design II | 78 | 2000 H | 5 pieces OK |
| Comparative Example G | | | |
| Design I | 76 | 5–28 Hr | 3 pieces BD |
| | | 2000 Hr | 2 pieces OK |
| Design II | 80 | 3–33 Hr | 4 pieces BD |
| | | 2000 Hr | 1 piece OK |

Figure 3:
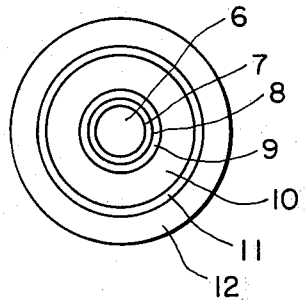
FIG. 3 is a cross-sectional view of an ignition cable of a multilayer construction.

Note:
**JIS C-3004-1975 "Rubber Insulated Cable Testing Method"
OK: Good,
BD: Breakdown Another embodiment of this invention will be explained by reference to FIG. 3.

A 1,500 denier aromatic polyamide fiber bundle 6 was coated with a carbon paint 7 and dried so that the outer diameter be 0.6 mm, and a semiconductive ethylene-propylene rubber layer 9 was extrusion-coated on the above coated aromatic polyamide fiber bundle on a silicone paint stripping layer 8 to provide a resistive-conductor core having an outer diameter of 1.1 mm. Furthermore, a polymer blend of polyethylene and an ethylene-propylene rubber was extruded on the core and cross-linked by irradiation with electron beam to form an insulator layer 10. On the insulator layer 10 were provided a glass braid 11 and an ethylene-propylene jacket 12 in that sequence to produce an ignition cable.

The thus-obtained ignition cable had an electrostatic capacity of 79 pF/m and provided satisfactorily good results in the ignition coil voltage withstanding test. In the working of termination, the insulator layer and the outer semiconductor layer of the core could be stripped from the stripping layer, and since the remaining portion of the ignition cable had sufficient conductivity, the working of termination could be easily performed.

With an ignition cable prepared in the same manner as described above except that an ethylene-vinyl acetate copolymer-based semiconductive compound was used as the outer semiconductive layer to be provided through the stripping layer, the electrostatic capacity was small, the high voltage withstanding ability was excellent, and terminals could be easily connected.

According to this invention, it has been found that the high voltage withstanding ability can be further increased by employing irradiation with electron beam in place of the conventional steam vulcanization in the cross-linking of the insulator and jacket. The phenomenon could not be expected with the usual cables comprising a copper conductor; that is, it is a common sense that with cross-linked polyethylenes obtained by irradiation with electron beam and steam vulcanization, there is no great difference therebetween with respect to the high voltage withstanding ability, or the cross-linked polyethylene obtained by irradiation with electron beam is somewhat lower than that obtained by steam vulcanization with respect to the high voltage withstanding ability, and furthermore that the polymer blend of the polyethylene and the ethylene-propylene rubber tends to be lower in the high voltage withstanding ability than the polyethylene alone. This is believed to be due to the fact that cooling under pressure after the steam vulcanization sufficiently makes foams in the insulator waterproof.

Unexpectedly, however, when the core is a resistive-conductor, the cross-linking of the polyethylene and the ethylene-propylene rubber or ethylene-$\alpha$-olefin copolymer or the like with irradiation of electron beam significantly increases the high voltage withstanding ability of the resulting ignition cable. In this way, therefore, an ignition cable having a low electrostatic capacity and a stabilized high voltage withstanding ability can be obtained.

Although the reason why such phenomenon occurs is not clear, it is believed that when a great pressure is applied in the steam vulcanization, the resistive-conductor core is liable to be deformed as compared with copper core because in the resistive-conductor core, there are a vacant space or voids among fibers, resulting in the formation of the irregularity in the surface and a reduction in the high voltage withstanding ability, whereas in the cross-linking by irradiation with electron beam, the above phenomenon is hard to occur because almost no pressure is applied in the cross-linking by irradiation with electron beam.

In this invention, aromatic polyamide fiber bundles as tension members may be twined or intertwined around a central aromatic polyamide fiber bundle. Furthermore, the reinforcing layer may be a perforated tape as well as a glass braid, and the jacket may be divided into two parts and the reinforcing layer may be provided between the two-divided jackets. But the reinforcing layer may be omitted.

While the invention has been described in detail and with reference to specific embodiments thereof, it will be apparent to one skilled in the art that various changes and modifications can be made therein without departing from the spirit and scope thereof.

What is claimed is:

1. A high voltage ignition cable having a low electrostatic capacity comprising a resistive-conductor core, an insulator layer provided thereon, and a jacket, wherein said insulator layer comprises a cross-linked product of a blended composition consisting of crystalline polyethylene and a non-crystalline olefin polymer.

2. A high voltage ignition cable having a low electrostatic capacity as in claim 1 wherein the non-crystalline olefin polymer is an ethylene propylene rubber and the blend ratio, by weight, of the polyethylene to the ethylene propylene rubber is from 80/20 to 50/50.

3. A high voltage ignition cable having a low electrostatic capacity as in claim 1 wherein the non-crystalline olefin polymer is an ethylene-$\alpha$-olefin copolymer and the blend ratio, by weight, of the polyethylene to the ethylene-$\alpha$-olefin copolymer is from 80/20 to 50/50.

4. A high voltage ignition cable having a low electrostatic capacity as in claim 1 wherein the resistive-conductor core is prepared by using an aromatic polyamide fiber bundle as a tension member and by coating thereon a semiconductive paint so that the outer diameter is of a maximum of 1.2 mm

5. A high voltage ignition cable having a low electrostatic capacity as in claim 1 wherein the resistive-conductor core prepared by coating a semiconductive paint on the tension member comprising an aromatic polyamide fiber bundle is extrusion coated with a semiconductive material on the semiconductive paint layer with a stripping layer interposed therebetween.

6. A high voltage ignition cable having a low electrostatic capacity as in claim 4 wherein the tension member of the resistive-conductor core is prepared by twining or intertwining a plurality of aromatic polyamide fiber bundles around a central aromatic polyamide fiber bundle.

7. A high voltage ignition cable having a low electrostatic as in claim 1 wherein the insulator layer is cross-linked by irradiation with electron beam.

* * * * *